US005469590A

United States Patent [19]

Simon

[11] Patent Number: 5,469,590

[45] Date of Patent: Nov. 28, 1995

[54] MATTRESS WITH COMPRESSIBLE SUPPORT MEMBERS

[75] Inventor: LeRoy J. Simon, Kildeer, Ill.

[73] Assignee: The Spring Air Company, Des Plaines, Ill.

[21] Appl. No.: 206,313

[22] Filed: Mar. 4, 1994

[51] Int. Cl.[6] ..... A47C 27/04

[52] U.S. Cl. ..... 5/475; 5/253; 5/477; 267/287

[58] Field of Search ..... 267/33, 287; 5/475, 5/477, 478, 480, 253, 474

[56] References Cited

U.S. PATENT DOCUMENTS

| | | | |
|---|---|---|---|
| 1,648,951 | 11/1927 | Knepper | 5/477 |
| 1,865,043 | 6/1932 | Pittoni . | |
| 2,309,239 | 1/1943 | Clark | 5/475 |
| 2,408,382 | 10/1946 | Dubick . | |
| 2,826,769 | 3/1958 | Drews . | |
| 2,940,089 | 6/1960 | Koenigsberg . | |
| 3,251,078 | 5/1966 | Calla . | |
| 3,262,135 | 7/1966 | Fasanella . | |
| 3,489,403 | 1/1970 | Kieffer | 267/287 |
| 3,517,398 | 6/1970 | Patton . | |
| 3,618,146 | 11/1971 | Ferdinand . | |
| 3,822,426 | 7/1974 | Mistarz . | |
| 3,848,283 | 11/1974 | Ikeda . | |
| 4,067,076 | 1/1978 | Krier . | |
| 4,092,749 | 6/1978 | Klancnik . | |
| 4,109,330 | 8/1978 | Klancnik . | |
| 4,129,908 | 12/1978 | Wagner . | |
| 4,234,983 | 11/1980 | Stumpf . | |
| 4,357,724 | 11/1982 | LaForest | 5/475 |
| 4,424,600 | 1/1984 | Callaway . | |
| 4,435,864 | 3/1984 | Callaway . | |
| 4,449,261 | 5/1984 | Magnusson . | |
| 4,451,946 | 6/1984 | Stumpf . | |
| 4,462,129 | 7/1984 | Brannock . | |
| 4,477,061 | 10/1984 | Kawaura et al. | 267/33 |
| 4,485,506 | 12/1984 | Stumpf et al. . | |
| 4,519,107 | 5/1985 | Dillion et al. . | |
| 4,523,344 | 6/1985 | Stumpf et al. . | |
| 4,566,926 | 1/1986 | Stumpf . | |
| 4,578,834 | 4/1986 | Stumpf . | |
| 4,677,701 | 7/1987 | Galumbeck . | |
| 4,907,309 | 3/1990 | Breckle . | |
| 5,016,305 | 5/1991 | Suenens et al. . | |
| 5,048,167 | 9/1991 | Heffley et al. . | |
| 5,105,488 | 4/1992 | Hutchinson et al. . | |
| 5,113,539 | 5/1992 | Strell . | |
| 5,126,004 | 6/1992 | Suenens et al. . | |
| 5,133,116 | 7/1992 | Wagner et al. . | |
| 5,186,435 | 2/1993 | Smith . | |
| 5,210,890 | 5/1993 | Hagglund | 5/475 |
| 5,239,715 | 8/1993 | Wagner . | |

OTHER PUBLICATIONS 6-page product brochure entitled "Spring Air® Back Supporter® Conforma Collection".

*Primary Examiner*—Michael J. Milano
*Attorney, Agent, or Firm*—Marshall, O'Toole, Gerstein, Murray & Borun

[57] ABSTRACT

A mattress is provided with an innerspring unit, one or more layers of foam material disposed over the innerspring unit, and a mattress cover enclosing the innerspring unit and foam layers. The innerspring unit has first and second border wires spaced apart from each other by a predetermined distance and a plurality of spring coils arranged in a plurality of rows between the border wires. Each of the coils is formed of a helical wire member having a plurality of spaced apart convolutions. A plurality of compressible support members are provided between adjacent rows of coils. The support members are generally in the shape of an I-beam, with an upper portion of a first width, a middle portion of a second width, and a lower portion of a third width. The upper portion of each support member is provided between a first two adjacent convolutions of the coil springs and the lower portion of each support member is provided between a second two adjacent convolutions of the coils. The compressible support members increase the effective stiffness of the coils, thus providing the mattress with increased firmness. In another embodiment, the support members may be provided with a positioning stub for anchoring them between adjacent rows of spring coils.

34 Claims, 3 Drawing Sheets

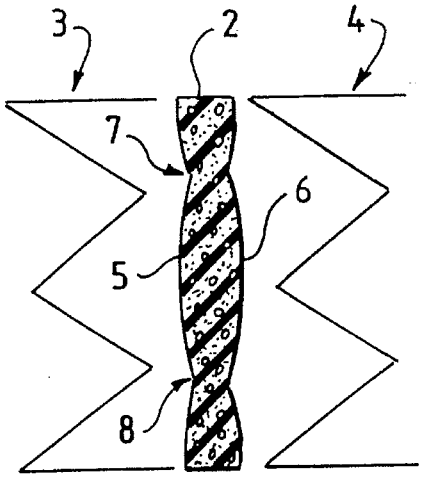
Fig. 1
PRIOR ART
Fig. 3
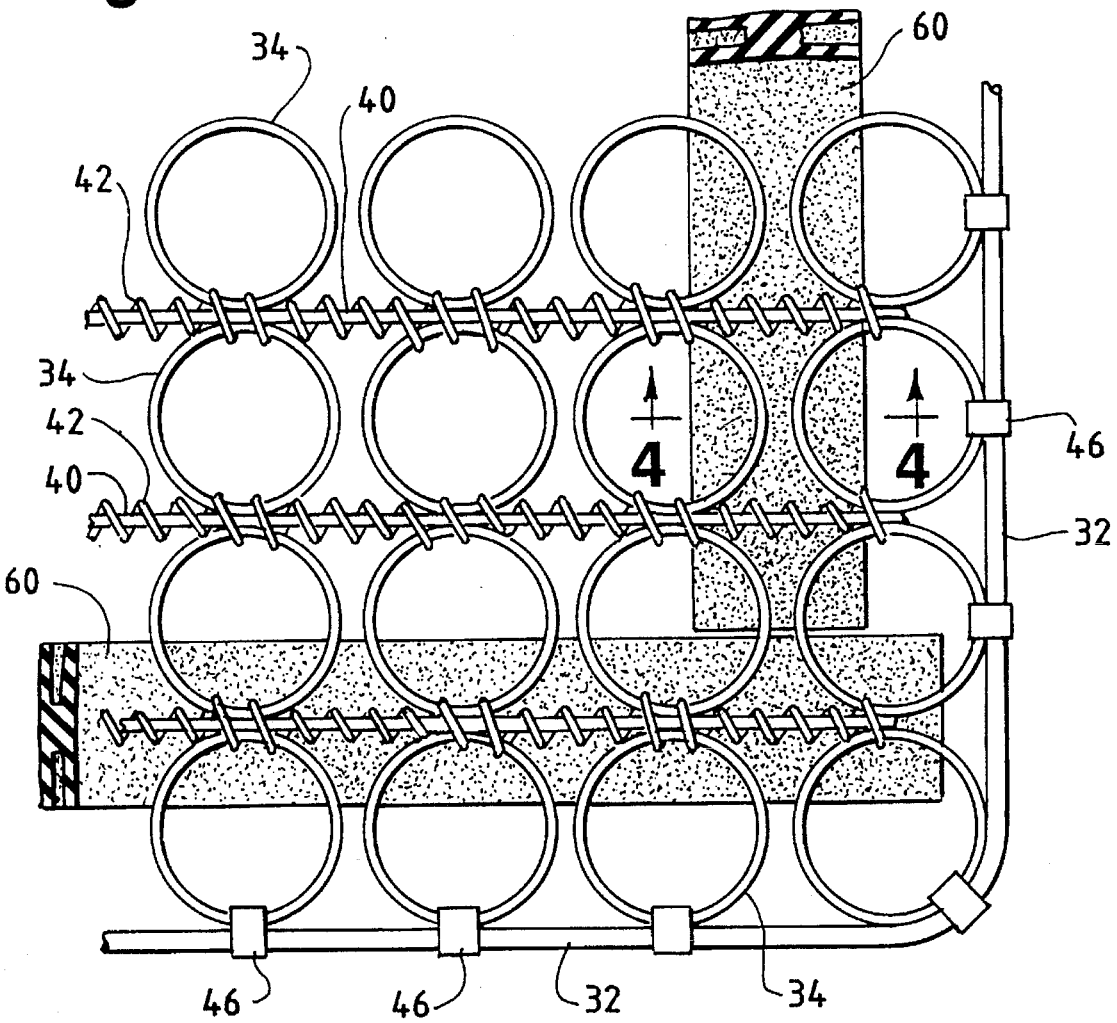

MATTRESS WITH COMPRESSIBLE SUPPORT MEMBERS

BACKGROUND OF THE INVENTION

The present invention relates to a mattress having an innerspring unit with one or more compressible support members to increase the firmness of the mattress.

A mattress is typically formed of an innerspring unit, one or more layers of padding material disposed over the innerspring unit, and a mattress cover. The innerspring unit typically has two spaced-apart, rectangular border wires with a plurality of rows of helical spring coils disposed between the two border wires. The structure, size, wire gauge, and spacing of the coils typically determines the firmness of the mattress. The spring coils in adjacent rows may be oppositely wound or coiled to eliminate "roll together" and mattress "lean" conditions.

It is generally desirable to design a mattress so that it has increased firmness about its periphery so that when a person sits on the edge of a mattress it does not collapse. U.S. Pat. No. 3,822,426 to Mistarz discloses a mattress topper pad and border stabilizer. In one embodiment illustrated in FIG. 1 of the Mistarz patent, a relatively large amount of foam material is provided at the top and bottom portions of the mattress as well as along the side of the mattress between the edge of the mattress and the peripheral row of coils adjacent the edge of the mattress. That foam material substantially fills the entire interior space of the coils of the peripheral row. One disadvantage of this embodiment of the Mistarz patent is the requirement of a relatively large amount of foam material.

In a second embodiment shown in FIG. 6 of the Mistarz patent, the foam material is provided only at a portion of the side of the mattress adjacent the top and bottom convolutions of the coils in the peripheral row. Because the foam material is not provided in the coil convolutions between the top and bottom coil convolutions, the amount of stiffening provided by the foam material is limited.

U.S. Pat. No. 3,618,146 to Ferdinand discloses a border stabilizer for a mattress which is similar to the first embodiment of the Mistarz patent described above. In the Ferdinand patent, the foam material is provided between the periphery of the mattress and the interior areas of the peripheral row of coils.

U.S. Pat. No. 2,940,089 to Koenigsberg discloses a mattress structure in which a vertical layer of foam material is provided between the edge of the mattress and the peripheral row of coils. The vertical layer of foam material is generally uniform in width, except for a number of slots formed therein to receive a like number of edges of the innerspring unit of the mattress.

U.S. Pat. No. 2,826,769 to Drews discloses a border stabilizer for a mattress comprising a vertical layer of foam material provided between the edge of the mattress and the peripheral row of coils. In one embodiment shown in FIGS. 3 and 4, the side of the border stabilizer adjacent the edge of the mattress is flat, whereas the side of the border stabilizer is convexly curved to conform to the shape of the peripheral row of coils. In a second embodiment shown in FIG. 6, both sides of the border stabilizer are substantially flat, and the top and bottom convolutions of the spring coils extend into the foam border stabilizer while the middle convolutions of the coils abut the side of the border stabilizer.

U.S. Pat. No. 5,138,116 to Wagner, et al. discloses a method of stabilizing and reinforcing the border of a mattress in which a continuous length of foam material is wound about the periphery of the innerspring unit of the mattress between the edge of the mattress and the peripheral row of coils. The foam material substantially fills the interior portions of the coils in the peripheral row.

U.S. Pat. No. 5,239,715 to Wagner discloses a border stabilizing and reinforcing member for use in a mattress. The member is in the shape of a rhombus, having top and bottom portions of a relatively small width and a middle portion of a relatively large width.

U.S. Pat. No. 5,048,167 to Heffley, et al. discloses a method for restoring a used mattress in which rectangular blocks of resilient material are inserted between adjacent rows of coil springs in the mattress. The rectangular blocks are composed of three distinct layers of foam material, a central core layer and top and bottom layers. The material of the core layer may be composed of a stiffer material than the top and bottom layers.

U.S. Pat. No. 4,907,309 to Breckle discloses various embodiments of a mattress having rows of spring coils, each of which is provided in a pocket of fabric material. Connecting walls of foam material having various shapes are disposed between the rows of spring coil pockets.

In a prior art border or edge stabilizer for a coil spring mattress, illustrated in FIG. 1, an elongate, vertically contoured foam stabilizer strip 2 is provided between and spaced apart from outer peripheral rows 3, 4 of spring coils, which are shown schematically. The two vertically extending side walls 5, 6 of the stabilizer strip 2 are contoured so that the width of the stabilizer strip 2 narrows to a minimum at two different vertical points 7, 8. The widths of the top, middle and bottom portions of the stabilizer strip 2 are approximately equal. No part of the stabilizer strip 2 is disposed between any convolutions of the spring coils. When the spring coils are compressed, the convolutions of the coils do not substantially contact the sides of the stabilizer strip 2. Thus, the primary manner in which the mattress edge is stiffened is due to vertical compression of the stabilizer strip 2.

SUMMARY OF THE INVENTION

The invention is directed to a mattress having an innerspring assembly or unit which is provided with one or more compressible foam support members to economically provide increased mattress firmness. The innerspring unit has a wire frame with first and second border wires spaced apart from each other by a predetermined distance to define first and second substantially parallel planes. A plurality of spring coils are arranged in a number of rows between the first and second planes defined by the first and second border wires. Each spring coil is formed of a helical wire member having a plurality of spaced-apart convolutions.

One or more compressible support members are provided between adjacent rows of the coils. In one embodiment of the invention, each support member has an upper portion of a first width, a middle portion of a second width, and a lower portion of a third width. The upper portion of each support member is provided between two adjacent convolutions of the helical wire members and the lower portion of each support member is provided between another two adjacent convolutions of the helical wire members. Preferably, the first and third widths of each compressible support member are substantially equal, and the second width of each compressible support member is substantially constant between the upper and lower portions, so that each compressible support member has a shape generally similar to that of an I-beam.

Each compressible support member includes first means for increasing the effective stiffness of the two rows of adjacent spring coils when the coils are subjected to a first threshold force and second means for increasing the effective stiffness of the two rows of adjacent coils when the coils are subjected to a second threshold force greater than the first threshold force.

In another embodiment of the invention, each compressible support member has an upper portion of a first substantially constant width, a middle portion of a second width greater than the first substantially constant width, and a lower portion of a third substantially constant width. The middle portion of the support member is disposed between two adjacent convolutions of the helical wire members between which the support member is provided and acts as a positioning stub to maintain the support member in position between adjacent rows of spring coils.

The compressible support members, which are preferably composed of a foam material, may be provided between pairs of rows of coils adjacent the periphery of the innerspring unit to provide a mattress having increased firmness about its periphery. The compressible support members may also be provided between the interior coil rows of the innerspring unit to provide additional firmness in the central portion of the mattress.

These and other features and advantages of the present invention will be apparent to those of ordinary skill in the art in view of the detailed description of the preferred embodiment, which is made with reference to the drawings, a brief description of which is provided below.

BRIEF DESCRIPTION OF THE DRAWINGS

FIG. 1 is an elevational view of a prior art foam stabilizer for a mattress provided between a pair of rows of spring coils;

FIG. 3 is a top view of a portion of the innerspring unit of the mattress of FIG. 2 showing the position of a number of compressible support members;

DETAILED DESCRIPTION OF A PREFERRED EMBODIMENT

Figure 2:
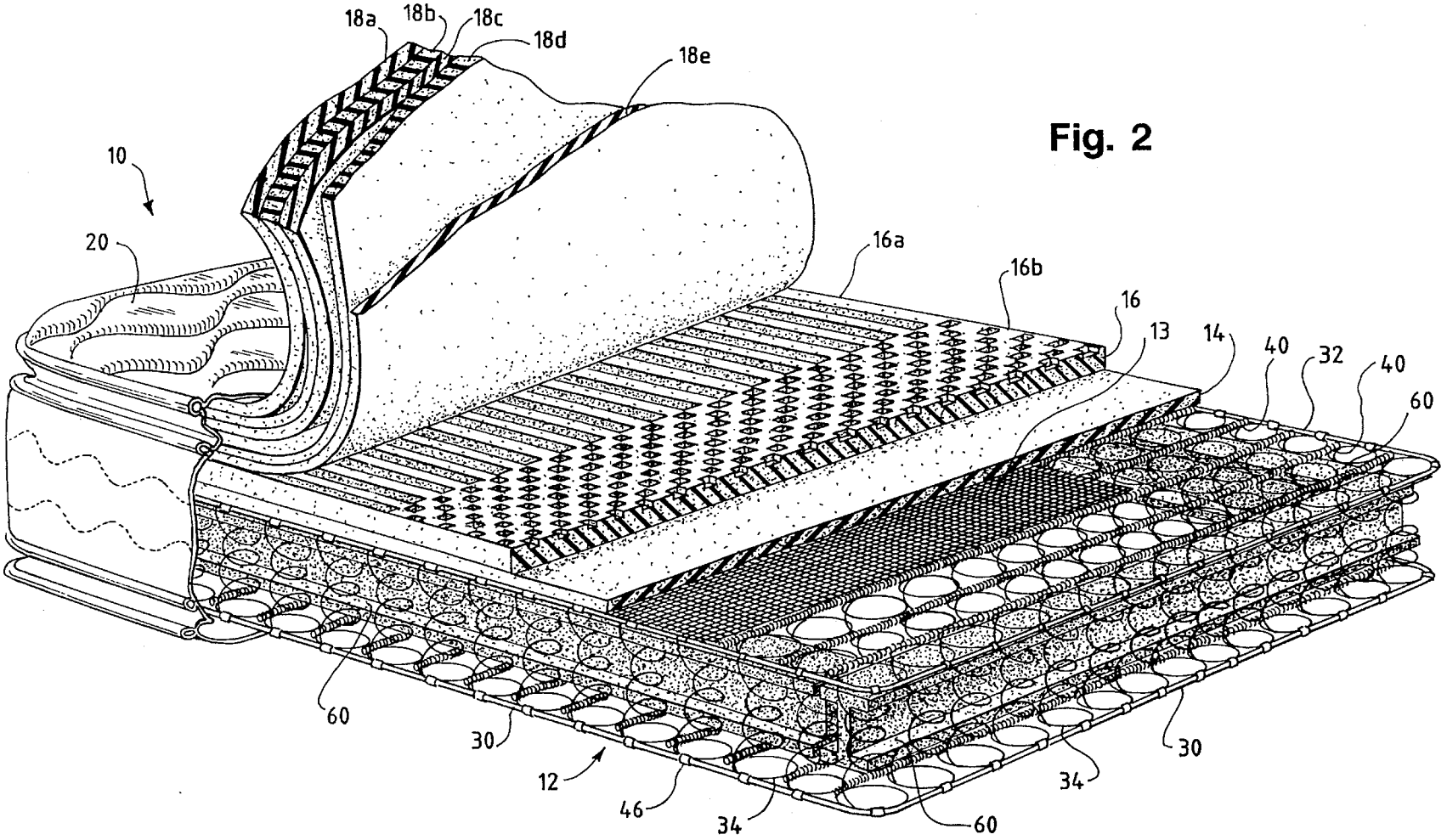
FIG. 2 is a perspective view of the interior portions of a mattress incorporating a number of compressible support members in accordance with one embodiment of the invention.

One embodiment of a mattress 10 in accordance with the invention is illustrated in FIG. 2. The mattress 10 includes a innerspring unit generally designated 12, a mesh layer 13 provided over the innerspring unit 12, a number of foam padding layers 14, 16, 18*a*–18*e* provided on top of the mesh layer 13, and a mattress cover 20 which encases the innerspring unit 12, the mesh layer 13, and the foam layers 14, 16, 18.

One of the foam layers 16 is shown to have a first section 16*a* having a number of slots formed therein and a second section 16*b* having a number cavities formed therein. The firmness of the foam layer section 16*a* having the slots is less than that of the foam layer section 16*b* having the cavities. The purpose of varying the firmness of the different foam layers is to comfortably accommodate the different anatomical portions of a person, such as the head, neck and shoulder area, the lumbar area, and the hip area. Although the number and locations of the zones of varying firmness may be suitably selected to provide any desired pattern of support, the particular design is not considered to be a feature of the invention. The mesh layer 13, the foam layers 14, 16, 18 and the mattress cover 20 are of conventional construction. It should be appreciated that the structure of FIG. 1 corresponds to a "deluxe" mattress, and that one or more of the foam layers 14, 16, 18 could be omitted in less expensive mattresses.

The overall shape of the innerspring unit 12 is defined by a pair of conventional, spaced-apart, generally rectangular border wires 30, 32. A relatively large number of spring coils 34 are provided between the two planes defined by the border wires 30, 32. The coils 34 are secured to the border wires 30, 32 in a conventional manner by a number of connecting rods or wires 40 which run across the width of the innerspring unit 12.

As shown in more detail in FIG. 3, each of the connecting wires 40 has an associated wire 42 spirally wound around it. The spiral wire 42 is wound around the uppermost (or lowermost) convolution of each of the coils 34 in the two rows of coils 34 associated with each wire 40 so that the coils 34 are held in place. The peripheral rows of coils 34 of the innerspring unit 12 are secured to the top and bottom border wires 30, 32 via a number of connectors 46.

Figure 4:
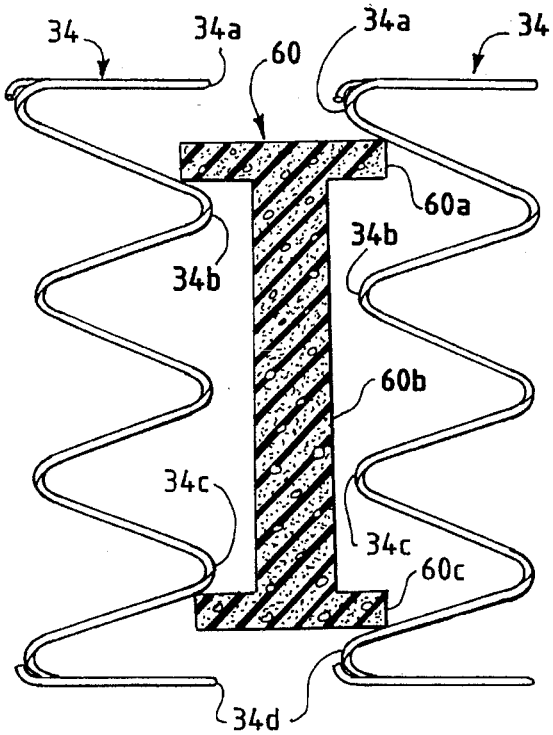
FIG. 4 is a side elevational view of a portion of the innerspring unit taken along lines 4—4 of FIG. 3.

The convolution direction (i.e. left-hand or right-hand spiral) of adjacent coils 34 may be alternated to eliminate mattress "lean" and "roll together." In FIG. 4, the two coils 34 shown have the same convolution direction. Although the coils 34 shown in FIG. 4 have five convolutions, coils with a different number of convolutions may be used. The coils 34 may be spaced more closely together in the center and/or about the periphery of the innerspring unit 12 to provide additional support in those areas. Also, heavy duty coils could be used in those areas to provide additional support. The structural details and spacing of the coils 34 are not considered to be features of the invention.

Referring to FIG. 3, the innerspring unit 12 includes a number of compressible support members 60 which are provided between pairs of adjacent rows of coils 34. In FIG. 3, each of the compressible support members 60 is shown between a peripheral row of coils 34 (the row of coils 34 next to the edge of the innerspring unit 12) and the row of coils 34 adjacent the peripheral row.

Each of the compressible support members 60 is formed of a conventional foam material, such as polyethylene or urethane foam, and is generally in the shape of an I-beam. Referring to FIG. 4, the compressible support member 60 is shown to include an upper portion 60*a* of a first constant width, a middle portion 60*b* of a second constant width smaller than the first width, and a lower portion 60*c* of a third constant width equal to the first width. Each side of the upper portion 60*a* of the support member 60 is provided between two adjacent convolutions 34*a*, 34*b* of the coils 34, and each side of the lower portion 60*c* of the support member 60 is provided between two adjacent convolutions 34*c*, 34*d* of the coils 34.

When the coils 34 are vertically compressed by the application of a given force to the mattress 10, the compressible support members 60 increase the effective stiffness of the coils 34, thus increasing the firmness of the innerspring unit 12 and the mattress 10. The increased stiffness may be achieved via two mechanisms.

First, because they are disposed in the interior of the coils 34 between pairs of convolutions of the coils 34, the upper and lower portions 60*a*, 60*c* of the compressible support members 60 restrict the amount by which the upper and lower convolutions of the coils 34 are vertically compressed when subject to a given force. In particular, referring to FIG. 4, when the coils 34 are subject to a threshold force, the space between the upper convolutions 34*a*, 34*b* will decrease until each of those convolutions 34*a*, 34*b* makes contact with a respective side of the upper portion 60*a* of the support member 60. Similarly, when subject to the threshold force, the space between the lower convolutions 34*c*, 34*d* will decrease until each of those convolutions 34*c*, 34*d* makes contact with a respective side of the lower portion 60*c* of the support member 60. If there is any increase in force above that threshold force, the upper and lower portions 60*a*, 60*c* will resist compression of the convolutions of the coils 34 and will therefore increase the effective stiffness of those convolutions, and thus the stiffness of those coils 34.

The compressible support members 60 also increase the firmness of the innerspring unit 12 in a second manner. When the coils 34 are subject to a threshold force sufficient to cause the upper convolutions 34*a* of the coils 34 to abut the top surface of the upper portion 60*a* of the compressible support member 60 and the lower convolutions 34*d* of the coils 34 to abut the bottom surface of the lower portion 60*c* of the compressible support member 60, any further increase in force will be resisted by the middle portion 60*b* of the compressible support member 60, thus increasing the effective stiffness of the coils 34 throughout their lengths and making the innerspring unit 12 firmer. This latter threshold force is typically less than the above-described threshold force necessary to cause the coil convolutions to abut both upper and lower sides of the upper and lower portions 60*a*, 60*c* of the support members 60.

The dimensions of the compressible support members 60 can be suitably designed to provide the coils 34 with any of a large number of force/deflection characteristics. For example, it should be noted that if the heights of the upper and lower portions 60*a*, 60*c* of the support member 60 are increased, the stiffness of the coils 34 adjacent the support member 60 will also be increased since a lower threshold force will be required to force both the upper and lower surfaces of the portions 60*a*, 60*c* into contact with both convolutions 34*a*, 34*b* of the coil 34. If the width of the middle portion 60*b* of the support member 60 is increased, the stiffness of the coils 34 adjacent the support member 60 will also increase.

The height of the compressible support member 60 may also be varied to affect the firmness of the mattress. For example, for maximum mattress firmness, the height of the compressible support member 60 should be made approximately equal to the height of the innerspring unit 12. For decreased mattress firmness, the height of the support members 60 should be decreased, in which case the support members 60 will not increase the effective stiffness of the coils 34 until the height of the innerspring unit 12 is reduced by force to the height of the support members 60. The compressible support members 60 could be provided in various lengths, such as two-foot lengths or longer. In one embodiment of the invention, the height of the support members 60 may be approximately five inches, the widths of the upper and lower portions 60*a*, 60*c* may be approximately one inch, and the width of the middle portion 60*b* may be approximately one-half of an inch.

The location of the support members 60 can also be designed to provide any desired overall mattress firmness. The support members 60 can be provided around the entire periphery of the innerspring unit 12, in which case they would be provided between each of the four peripheral rows of the coils 34 and a respective row adjacent one of the four peripheral rows. Additionally, the support members 60 can be provided between one or more pairs of coil rows in the central portion of the innerspring unit 12 to provide increased firmness in the center of the mattress 10.

Furthermore, the spacing of the compressible support members 60 can be designed to provide a desired overall mattress firmness. For example, the compressible support members 60 could be provided between every pair of rows of coils 34 along one direction to provide maximum mattress firmness. Alternatively, the compressible support members 60 could be provided in every other row or every third row for intermediate mattress firmness.

Figure 5:
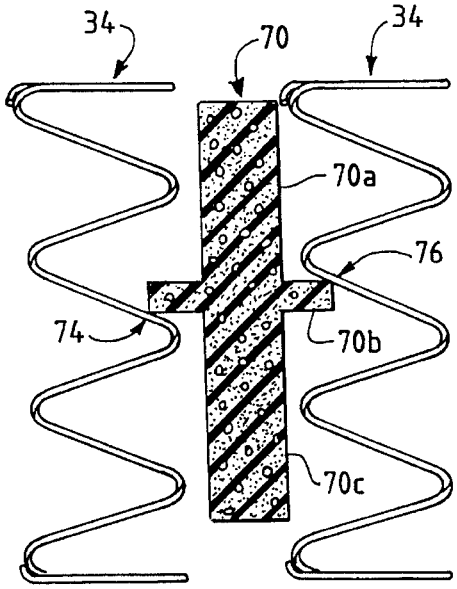
FIG. 5 is a side elevational view of an alternative embodiment of a compressible support member in accordance with the invention.

A second embodiment of a compressible support member 70 which may be incorporated in the mattress embodiment of FIG. 2 is illustrated in FIG. 5 with respect to a pair of spring coils 34. The compressible support member 70 of FIG. 5 has an upper portion 70*a* of a substantially constant width, a middle portion 70*b* of a larger substantially constant width than the upper portion 70*a*, and a lower portion of a substantially constant width equal to that of the upper portion 70*a*. Each side of the middle portion 70*b* of the support member 70 extends between a pair of adjacent convolutions of the coils 34. The middle portion 70*b*, which abuts the coil 34 shown in the left-hand portion of FIG. 5 at a point 74 and abuts the coil 34 shown in the right-hand portion of FIG. 5 at a point 76, acts as a positioning stub to maintain or anchor the compressible support member 70 in position between adjacent rows of coils 34. The portion 70*b* is provided at a point approximately equidistant between the upper and lower ends of the support member 70. The support member 70 may be composed of the foam materials described above, and its dimensions may be varied.

Figure 6:
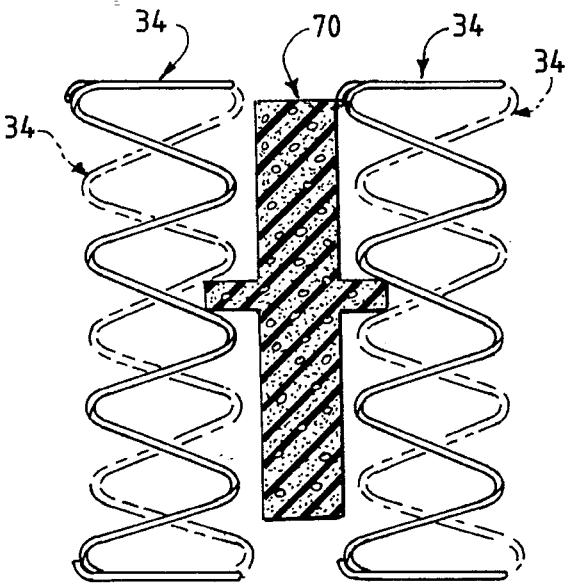
FIG. 6 is a side elevational view of the compressible support member of FIG. 5 with respect to coil rows of alternating convolution direction.

It should be understood that, while the coils 34 shown in FIGS. 4 and 5 have the same convolution direction, those coils may have opposite convolution directions. Referring to FIG. 6, the compressible support member 70 is shown with respect to two rows of coils 34, one row of coils 34 being shown on the left-hand side of the support member 70 and a second row of coils 34 being shown on the right-hand side of the support member 70. Every other coil in each row has a first convolution direction (indicated by solid lines) and the remaining coils have the opposite convolution direction (indicated by dotted lines). Thus, the convolution direction of the coils in each row alternates, coil by coil. It can be seen that the support member 70 may be disposed between the two rows of coils 34 despite the alternating convolution directions.

Modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. A mattress comprising:

a wire frame comprising first and second border wires spaced apart from each other by a predetermined distance, said first and second border wires defining first and second substantially parallel planes, respectively;

a plurality of spring coils provided between said first and second planes defined by said first and second border wires, said spring coils being arranged in a number of rows comprising at least a first row and a second row adjacent to said first row, each of said spring coils being formed of a helical wire member having a plurality of spaced-apart convolutions;

a compressible support member provided between said first and second planes defined by said first and second border wires, said support member being disposed between said first and second rows of said spring coils, said support member having an upper portion of a first width, a middle portion of a second width, and a lower portion of a third width, said upper portion of said support member being projected between a first two of said spaced-apart convolutions of one helical wire members and said lower portion of said support member being projected between a second two of said spaced-apart convolutions of said one helical wire member;

a mattress cover covering said wire frame, said spring coils, and said compressible support member; and a layer of padding material disposed between said mattress cover and one of said first and second planes defined by said first and second border wires.

2. A mattress as defined in claim 1 wherein said first and third widths of said upper and lower portions of said compressible support member are substantially equal.

3. A mattress as defined in claim 1 wherein said first row of said spring coils comprises a peripheral row of spring coils adjacent an edge of said wire frame.

4. A mattress as defined in claim 1 wherein said first and second rows of said spring coils are located in a central portion of said wire frame to provide increased firmness in the central portion of the mattress.

5. A mattress comprising:

a wire frame comprising first and second border wires spaced apart from each other by a predetermined distance, said first and second border wires defining first and second substantially parallel planes, respectively;

a plurality of spring coils provided between said first and second planes defined by said first and second border wires, said spring coils being arranged in a number of rows comprising at least a first row and a second row adjacent to said first row, each of said spring coils being formed of a helical wire member having a plurality of spaced-apart convolutions;

a compressible support member provided between said first and second planes defined by said first and second border wires, said support member being disposed between said first and second rows of said spring coils, said support member having an upper portion of a first width, a middle portion of a second width, and a lower portion of a third width, said upper portion of said support member being provided between a first two of said spaced-apart convolutions of said helical wire members and said lower portion of said support member being provided between a second two of said spaced-apart convolutions of said helical wire members, wherein said first and third widths of said upper and lower portions of said compressible support member are substantially, equal and wherein said second width of said middle portion of said compressible support member is substantially constant between said upper and lower portions so that said compressible support member has a shape that is generally similar to an I-beam;

a mattress cover covering said wire frame, said spring coils, and said compressible support member; and a layer of padding material disposed between said mattress cover and one of said first and second planes defined by said first and second border wires.

6. A mattress comprising:

a wire frame comprising first and second border wires spaced apart from each other by a predetermined distance, said first and second border wires defining first and second substantially parallel planes, respectively;

a plurality of spring coils provided between said first and second planes defined by said first and second border wires, said spring coils being arranged in a number of rows comprising at least four peripheral rows adjacent the periphery of said mattress and four additional rows, each of said additional rows being disposed adjacent one of said peripheral rows, each of said spring coils being formed of a helical wire member having a plurality of spaced-apart convolutions;

a plurality of compressible support members provided between said first and second planes defined by said first and second border wires, each of said support members being disposed between one of said peripheral rows and a respective one of said additional rows of said spring coils, each of said support members having an upper portion of a first width, a middle portion of a second width, and a lower portion of a third width, each of said upper portions of said support members being projected between a first two of said spaced-apart convolutions of one of said helical wire members and each of said lower portions of said support members being projected between a second two of said spaced-apart convolutions of said one helical wire member;

a mattress cover covering said wire frame, said spring coils, and said compressible support members; and a layer of padding material disposed between said mattress cover and one of said first and second planes defined by said first and second border wires.

7. A mattress as defined in claim 6 wherein said first and third widths of each of said compressible support members are substantially equal.

8. A mattress comprising:

a wire frame comprising first and second border wires spaced apart from each other by a predetermined distance, said first and second border wires defining first and second substantially parallel planes, respectively;

a plurality of spring coils provided between said first and second planes defined by said first and second border wires, said spring coils being arranged in a number of rows comprising at least four peripheral rows adjacent the periphery of said mattress and four additional rows, each of mid additional rows being disposed adjacent one of said peripheral rows, each of said spring coils being formed of a helical wire member having a plurality of spaced-apart convolutions;

a plurality of compressible support members provided between said first and second planes defined by said first and second border wires, each of said support member being disposed between one of said peripheral rows and a respective one of said additional rows of said spring coils, each of said support members having an upper portion of a first width, a middle portion of a second width, and a lower portion of a third width, each of said upper portions of said support members being provided between a first two of said spaced-apart convolutions of said helical wire members and each of said lower portions of said support members being provided between a second two of said spaced-apart convolutions of said helical wire members, wherein said first and third widths of each of said compressible support members are substantially equal and wherein said second width of each of said compressible support members is substantially constant between said upper and lower portions so that said compressible support members have a shape that is generally similar to an I-beam;

a mattress cover covering said wire frame, said spring coils, and said compressible support members; and a layer of padding material disposed between said mattress cover and one of said first and second planes defined by said first and second border wires.

9. A mattress comprising:

a wire frame comprising first and second border wires spaced apart from each other by a predetermined distance, said first and second border wires defining first and second substantially parallel planes, respectively;

a plurality of spring coils provided between said first and second planes defined by said first and second border wires, said spring coils being arranged in a number of rows comprising at least a first row and a second row adjacent to said first row, each of said spring coils being formed of a helical wire member having a plurality of spaced apart convolutions;

a compressible support member provided between said first and second planes defined by said first and second border wires, said support member being disposed between said first and second rows of said spring coils, said support member comprising:

first means for increasing the effective stiffness of said first and second rows of said spring coils when said first and second rows of said spring coil are subjected to a first threshold force; and second means for increasing the effective stiffness of said first and second rows of said spring coils when said first and second rows of said spring coils are subjected to a second threshold force greater than said first threshold force, one of said first or second means projecting between spaced apart convolutions of said spring coils;

a mattress cover covering said wire frame, said spring coils, and said compressible support member; and a layer of padding material disposed between said mattress cover and one of said first and second planes defined by said first and second border wires.

10. A mattress as defined in claim 9 wherein said first means increases the effective stiffness of said first and second rows of said spring coils to a first value when said first and second rows of said spring coils are subjected to said first threshold force and wherein said second means increases the effective stiffness of said first and second rows of said spring coils to a second value greater than said first value when said first and second rows of said spring coils are subjected to said second threshold force.

11. A mattress comprising:

a wire frame comprising first and second border wires spaced apart from each other by a predetermined distance, said first and second border wires defining first and second substantially parallel planes, respectively;

a plurality of spring coils provided between said first and second planes defined by said first and second border wires, said spring coils being arranged in a number of rows comprising at least a first row and a second row adjacent to said first row, each of said spring coils being formed of a helical wire member having a plurality of spaced apart convolutions;

a compressible support member provided between said first and second planes defined by said first and second border wires, said support member being disposed between said first and second rows of said spring coils, said compressible support member having an upper portion of a first substantially constant width, a middle portion of a second width greater than said first substantially constant width, and a lower portion of a third substantially constant width, said middle portion of said support member being disposed between two of said convolutions of said helical wire members;

a mattress cover covering said wire frame, said spring coils, and said compressible support member; and a layer of padding material disposed between said mattress cover and one of said first and second planes defined by said first and second border wires.

12. A mattress as defined in claim 11 wherein said first and third widths of said upper and lower portions of said compressible support member are substantially equal.

13. A mattress as defined in claim 12 wherein said second width of said middle portion of said compressible support member is substantially constant.

14. A mattress as defined in claim 11 wherein said first row of said spring coils comprises a peripheral row of spring coils adjacent an edge of said wire frame.

15. A mattress as defined in claim 11 wherein said first and second rows of said spring coils are located in a central portion of said wire frame to provide increased firmness in the central portion of the mattress.

16. A mattress comprising:

a plurality of spring coils arranged in a number of rows comprising at least a first row and a second row adjacent to said first row, each of said spring coils being formed of a helical wire member having a plurality of spaced-apart convolutions; and a compressible support member disposed between said first and second rows of said spring coils, said support member having an upper portion of a first width, a middle portion of a second width, and a lower portion of a third width, said upper portion of said support member being projected between a first two of said spaced-apart convolutions of one of said helical wire members and said lower portion of said support member being projected between a second two of said spaced-apart convolutions of said one helical wire member.

17. A mattress as defined in claim 16 further comprising:

an outer mattress cover covering said spring coils and said compressible support member; and a layer of padding material disposed between said mattress cover and said spring coils.

18. A mattress as defined in claim 16 wherein said first and third widths of said upper and lower portions of said compressible support member are substantially equal.

19. A mattress as defined in claim 16 wherein said first row of said spring coils comprises a peripheral row of spring coils adjacent a peripheral edge of said mattress.

20. A mattress as defined in claim 16 wherein said first and second rows of said spring coils are located in a central portion of said mattress to provide increased firmness in the central portion of the mattress.

21. A mattress comprising:

a plurality of spring coils arranged in a number of rows comprising at least a first row and a second row adjacent to said first row, each of said spring coils being formed of a helical wire member having a plurality of spaced-apart convolutions; and a compressible support member disposed between said first and second rows of said spring coils, said support member having an upper portion of a first width, a middle portion of a second width, and a lower portion of a third width, said upper portion of said support member being provided between a first two of said spaced-apart convolutions of said helical wire members and said lower portion of said support member being provided between a second two of said spaced-apart convolutions of said helical wire members, wherein said first and third widths of said upper and lower portions of said compressible support member are substantially equal and wherein said second width of said middle portion of said compressible support member is substantially constant between said upper and lower portions so that said compressible support member has a shape that is generally similar to an I-beam.

22. A mattress comprising:

a plurality of vertically compressible spring coils provided between first and second horizontal planes, said spring coils being arranged in a number of rows comprising at least four peripheral rows adjacent the outer periphery of said mattress and four additional rows, each of said additional rows being disposed adjacent one of said peripheral rows, each of said spring coils being formed of a helical wire member having a plurality of vertically spaced-apart convolutions; and a plurality of vertically compressible support members provided between said first and second planes, each of said support members being disposed between one of said peripheral rows and a respective one of said additional rows of said spring coils, each of said support members having an upper portion of a first width, a middle portion of a second width, and a lower portion of a third width, each of said upper portions of said support members being projected between a first two of said spaced-apart convolutions of one of said helical wire members and each of said lower portions of said support members being projected between a second two of said spaced-apart convolutions of said one helical wire member.

23. A mattress as defined in claim 22 further comprising:

a mattress cover covering said spring coils and said compressible support members; and a layer of padding material disposed between said mattress cover and one of said first and second planes.

24. A mattress as defined in claim 22 wherein said first and third widths of each of said compressible support members are substantially equal.

25. A mattress comprising:

a plurality of vertically compressible spring coils provided between first and second horizontal planes, said spring coils being arranged in a number of rows comprising at least four peripheral rows adjacent the outer periphery of said mattress and four additional rows, each of said additional rows being disposed adjacent one of said peripheral rows, each of said spring coils being formed of a helical wire member having a plurality of vertically spaced-apart convolutions; and a plurality of vertically compressible support members provided between said first and second planes, each of said support members being disposed between one of said peripheral rows and a respective one of said additional rows of said spring coils, each of said support members having an upper portion of a first width, a middle portion of a second width, and a lower portion of a third width, each of said upper portions of said support members being provided between a first two of said spaced-apart convolutions of said helical wire members and each of said lower portions of said support members being provided between a second two of said spaced-apart convolutions of said helical wire member, wherein said first and third widths of each of said compressible support members are substantially equal and wherein said second width of each of said compressible support members is substantially constant between said upper and lower portions so that said compressible support members have a shape that is generally similar to an I-beam.

26. A mattress comprising:

a plurality of spring coils provided between said first and second planes, said spring coils being arranged in a number of rows comprising at least a first row and a second row adjacent to said first row, each of said spring coils being formed of at least one helical wire member and having a plurality of spaced apart convolutions; and a compressible support member provided between said first and second planes, said support member being disposed between said first and second rows of said spring coils, said support member comprising:

first means for increasing the effective stiffness of said first and second rows of said spring coils when said first and second rows of said spring coils are subjected to a first threshold force; and second means for increasing the effective stiffness of said first and second rows of said spring coils when said first and second rows of said spring coils are subjected to a second threshold force greater than said first threshold force, one of said first or second means projecting between spaced apart convolution of said spring coils.

27. A mattress as defined in claim 26 further comprising:

a mattress cover covering said spring coils and said compressible support member; and a layer of padding material disposed between said mattress cover and one of said first and second planes.

28. A mattress as defined in claim 26 wherein said first means increases the effective stiffness of said first and second rows of said spring coils to a first value when said first and second rows of said spring coils are subjected to said first threshold force and wherein said second means increases the effective stiffness of said first and second rows of said spring coils to a second value greater than said first value when said first and second rows of said spring coils are subjected to said second threshold force.

29. A mattress comprising:

a plurality of spring coils arranged in a number of rows comprising at least a first row and a second row adjacent to said first row, each of said spring coils being formed of a helical wire member having a plurality of spaced apart convolutions; and a compressible support member disposed between said first and second rows of said spring coils, said compressible support member having an upper portion of a first substantially constant width, a middle portion of a second width greater than said first substantially constant width, and a lower portion of a third substantially constant width, said middle portion of said support member being projected between two of said convolutions of said helical wire members.

30. A mattress as defined in claim 29 further including a mattress cover covering said spring coils and said compressible support member.

31. A mattress as defined in claim 29 wherein said first and third widths of said upper and lower portions of said compressible support member are substantially equal.

32. A mattress as defined in claim 31 wherein said second width of said middle portion of said compressible support member is substantially constant.

33. A mattress as defined in claim 29 wherein said first row of said spring coils comprises a peripheral row of spring coils adjacent a peripheral edge of said mattress.

34. A mattress as defined in claim 29 wherein said first and second rows of said spring coils are located in a central portion of said mattress to provide increased firmness in the central portion of the mattress.

* * * * *